US010712003B2

(12) United States Patent
Mulcaire

(10) Patent No.: US 10,712,003 B2
(45) Date of Patent: Jul. 14, 2020

(54) COMBUSTION CHAMBER ASSEMBLY

(71) Applicant: ROLLS-ROYCE plc, London (GB)

(72) Inventor: Thomas G Mulcaire, Derby (GB)

(73) Assignee: ROLLS-ROYCE PLC, London (GB)

( * ) Notice: Subject to any disclaimer, the term of this patent is extended or adjusted under 35 U.S.C. 154(b) by 610 days.

(21) Appl. No.: 15/454,590

(22) Filed: Mar. 9, 2017

(65) Prior Publication Data

US 2017/0276356 A1 Sep. 28, 2017

(30) Foreign Application Priority Data

Mar. 22, 2016 (GB) ..... 1604790.4

(51) Int. Cl.
*F23R 3/28* (2006.01)
*F23R 3/00* (2006.01)

(52) U.S. Cl.
CPC ..... *F23R 3/002* (2013.01); *F23R 3/28* (2013.01); *F23R 3/283* (2013.01); *F23R 2900/00012* (2013.01)

(58) Field of Classification Search
CPC .. F23R 3/28; F23R 3/283; F23R 3/286; F23R 3/50; F23R 3/60; F23R 3/343; F23R 3/346; F23R 3/54; F23R 2900/00017
See application file for complete search history.

(56) References Cited

U.S. PATENT DOCUMENTS 4,189,913 A * 2/1980 Carlisle ..... F23D 11/12 239/295
4,454,711 A * 6/1984 Ben-Porat ..... F23R 3/10 60/748
4,466,240 A * 8/1984 Miller ..... F23R 3/283 60/740
4,693,074 A * 9/1987 Pidcock ..... F23C 3/00 60/740

(Continued)

FOREIGN PATENT DOCUMENTS

EP 1 443 190 A1 8/2004
EP 2 518 407 A2 10/2012

(Continued)

OTHER PUBLICATIONS

Sep. 21, 2016 Search Report issued in British Patent Application No. 1604790.4.

*Primary Examiner* — William H Rodriguez
(74) *Attorney, Agent, or Firm* — Oliff PLC

(57) ABSTRACT

A combustion chamber assembly comprises an annular combustion chamber casing, a combustion chamber, a fuel injector and a tubular seal. The combustion chamber comprises an upstream end wall having an aperture extending there-through. A fuel injector head of the fuel injector is locatable in the aperture in the end wall and the fuel injector head has an axis. The tubular seal is positioned between the fuel injector head and the aperture in the end wall and the tubular seal has a flange and an aperture extends there- (Continued)

through. The tubular seal is movable radially and circumferentially with respect to the axis of the casing. The fuel injector head is locatable in the tubular seal. The aperture in the upstream end wall has a major radial dimension and a minor circumferential dimension relative to the axis of the casing to allow insertion or removal of a lean burn fuel injector head.

15 Claims, 7 Drawing Sheets

(56) References Cited

U.S. PATENT DOCUMENTS 4,773,596 A * 9/1988 Wright ..... F23C 7/004 239/400
4,934,145 A * 6/1990 Zeisser ..... F23R 3/002 60/740
5,165,241 A * 11/1992 Joshi ..... F23R 3/14 60/737
5,351,475 A * 10/1994 Ansart ..... F23R 3/10 60/746
5,373,694 A * 12/1994 Clark ..... F23D 11/38 60/740
5,419,115 A * 5/1995 Butler ..... F23R 3/10 60/740
5,533,330 A * 7/1996 Mullooly ..... F23R 3/283 60/39.821
5,735,117 A * 4/1998 Toelle ..... F02C 7/228 60/39.094
5,956,955 A * 9/1999 Schmid ..... F23R 3/283 60/748
6,164,074 A * 12/2000 Madden ..... F23R 3/283 60/750
6,571,559 B1 * 6/2003 Fortuna ..... F02C 7/22 60/748
6,735,950 B1 * 5/2004 Howell ..... F23R 3/14 29/890.02
7,628,019 B2 * 12/2009 Tanner ..... F23C 5/02 239/399
10,408,456 B2 * 9/2019 Mulcaire ..... F23R 3/16
2002/0178734 A1 * 12/2002 Stastny ..... F23R 3/283 60/796
2003/0164410 A1 * 9/2003 Steinthorsson ..... F23D 11/107 239/533.2
2005/0235647 A1 10/2005 Boston et al.
2006/0207258 A1 * 9/2006 Tanner ..... F23C 5/02 60/748
2007/0169486 A1 * 7/2007 Hernandez ..... F23R 3/14 60/776
2007/0199329 A1 * 8/2007 Hernandez ..... F23R 3/283 60/746
2008/0202122 A1 * 8/2008 Guezengar ..... F23R 3/002 60/722
2009/0044538 A1 * 2/2009 Pelletier ..... F23R 3/14 60/740
2009/0049840 A1 * 2/2009 Cayre ..... F23R 3/14 60/748
2009/0151361 A1 * 6/2009 Audin ..... F23R 3/002 60/796
2010/0107653 A1 * 5/2010 Paskevich ..... F23R 3/283 60/796
2010/0205971 A1 * 8/2010 Williams ..... F23D 11/107 60/748
2010/0229559 A1 * 9/2010 Lains ..... F02C 7/266 60/740
2010/0287939 A1 * 11/2010 Cornwell ..... F23C 7/002 60/748
2011/0088402 A1 * 4/2011 Commaret ..... F23R 3/283 60/755
2012/0234013 A1 * 9/2012 Overman ..... F23C 9/006 60/772
2012/0234944 A1 * 9/2012 Overman ..... F23R 3/28 239/553.5
2012/0292408 A1 * 11/2012 Short ..... F23D 11/103 239/463
2013/0036739 A1 * 2/2013 Horikawa ..... F23R 3/14 60/735
2013/0042620 A1 * 2/2013 Rose ..... B23K 9/028 60/734
2014/0007580 A1 1/2014 Richardson et al.
2014/0007583 A1 * 1/2014 Harding ..... F23R 3/286 60/776
2014/0246518 A1 * 9/2014 Myers ..... F23D 11/105 239/406
2014/0250917 A1 9/2014 Garry
2014/0352316 A1 12/2014 Fadde et al.
2015/0285500 A1 * 10/2015 Bourgois ..... F02C 7/22 60/740
2016/0215983 A1 * 7/2016 Rullaud ..... F23R 3/10
2016/0236271 A1 * 8/2016 Xu ..... B22C 9/10
2016/0327274 A1 * 11/2016 Blaney ..... F23R 3/28
2016/0369701 A1 * 12/2016 Pireyre ..... F02C 7/266
2017/0122565 A1 * 5/2017 Mulcaire ..... F23R 3/16
2017/0159939 A1 * 6/2017 Kobayashi ..... F02C 7/232
2017/0218845 A1 * 8/2017 Snyder ..... F02C 7/185
2018/0058696 A1 * 3/2018 Danis ..... F23R 3/14
2018/0163635 A1 * 6/2018 Marocchini ..... F23N 1/005
2018/0187889 A1 * 7/2018 Mulcaire ..... F23R 3/283

FOREIGN PATENT DOCUMENTS

EP 2 518 408 A2 10/2012
GB 2 073 398 A 10/1981
GB 2 490 348 A 10/2012

* cited by examiner

COMBUSTION CHAMBER ASSEMBLY

The present disclosure concerns a combustion chamber assembly and in particular to a combustion chamber assembly for a gas turbine engine.

A typical combustion chamber assembly comprises an annular combustion chamber casing, an annular combustion chamber, a plurality of fuel injectors and a plurality of tubular seals. The annular combustion chamber casing has a plurality of apertures extending there-through. The annular combustion chamber comprises an annular upstream end wall which has a plurality of apertures extending there-through. Each fuel injector comprises a fuel feed arm, a flange and a fuel injector head and each fuel injector locates in a respective one of the apertures in the annular combustion chamber casing. The flange of each fuel injector is secured to the annular combustion chamber casing. The fuel injector head of each fuel injector is located in a respective one of the apertures in the upstream end wall of the annular combustion chamber. Each tubular seal is positioned between an associated fuel injector head and the corresponding aperture in the upstream end wall of the annular combustion chamber. Each tubular seal has a flange and an aperture which extends through the tubular seal and the tubular seal is arranged generally coaxially with the axis of the corresponding aperture in the upstream end wall of the annular combustion chamber. Each tubular seal is movable radially with respect to the axis of the associated aperture in the upstream end wall of the annular combustion chamber casing. Each fuel injector head is located in the associated tubular seal and the fuel injector head abuts the associated tubular seal.

Thus, the fuel injector heads of the fuel injectors are sealed to the annular combustion chamber by the tubular seals. In operation the annular combustion chamber heats up more rapidly than the annular combustion chamber casing and thus they expand at different rates. The tubular seals are able to move relative to the annular combustion chamber to accommodate the differential radial thermal expansion of the annular combustion casing and the annular combustion chamber while providing seals around the fuel injector heads. The tubular seals are able to move relative to the annular combustion chamber to accommodate axial expansion of the annular combustion chamber through the tubular seals sliding relative to the fuel injector heads of the fuel injectors.

The fuel injectors are installed and removed from the annular combustion chamber using the apertures extending through the annular combustion chamber casing. The apertures in the annular combustion chamber casing are designed to have a suitable diameter to allow each fuel injector to be moved generally axially away from the upstream end wall of the annular combustion chamber to enable the fuel injector head of the fuel injector to disengage from the respective tubular seal, e.g. move axially with respect to the tubular seal and out of the tubular seal, and to allow each fuel injector to be moved generally axially towards the upstream end wall of the annular combustion chamber to enable the fuel injector head of the fuel injector to engage the respective tubular seal, e.g. move axially with respect to the tubular seal and into the tubular seal. The apertures in the annular combustion chamber are therefore generally larger in diameter than that required for purely relative thermal expansion of the annular combustion chamber relative to the fuel injectors.

The above arrangement is adequate for conventional rich burn fuel injectors which comprise fuel injector heads with a relatively small outside diameter and relatively small axial length.

However, lean burn fuel injectors comprise fuel injector heads with a larger outside diameter and a longer axial length than the fuel injector heads of rich burn fuel injectors and have to be moved a larger axial distance before the fuel injector heads can be disengaged from, or engaged with, the associated tubular seals. Furthermore, additional radial clearance has to be provided between the tubular seals and the upstream end wall of the combustion chamber to allow the axial movement of the lean burn fuel injectors. Additionally, if the outlet of the high pressure compressor and the inlet of the turbine are at different radii it is necessary to angle the combustion chamber with respect to the axis of the gas turbine engine. The requirement to fit lean burn fuel injectors, the requirement to provide an angled combustion chamber and the requirement for increased radial clearances results in an increase in the diameters of the apertures in the upstream end wall of the annular combustion chamber. The increased diameters of the apertures in the upstream end wall of the annular combustion chamber reduces the distances, and the amount of material, between these apertures which reduces the strength of the upstream end wall and reduces the space available to provide cooling holes in the upstream end wall.

Accordingly, the present disclosure seeks to provide a combustion chamber assembly which reduces, or overcomes, the above mentioned problem.

According to a first aspect of the present disclosure there is provided a combustion chamber assembly comprising an annular combustion chamber casing, at least one combustion chamber, at least one fuel injector and at least one tubular seal, the combustion chamber casing having an axis and at least one aperture extending there-through, the combustion chamber having a centre line, the combustion chamber comprising an upstream end wall having at least one aperture extending there-through, the at least one fuel injector comprising a fuel feed arm, a flange and a fuel injector head, the at least one fuel injector being locatable in the at least one aperture in the annular combustion chamber casing, the flange of the at least one fuel injector being securable to the annular combustion chamber casing, the fuel injector head of the at least one fuel injector being locatable in the at least one aperture in the upstream end wall, the fuel injector head having an axis and a plurality of annular passages, the at least one tubular seal being positionable between the fuel injector head and the at least one aperture in the upstream end wall, the at least one tubular seal having a flange, an aperture extending through the at least one tubular seal, the at least one tubular seal being movable radially and circumferentially with respect to the axis of the annular combustion chamber casing, the fuel injector head being locatable in the at least one tubular seal, and the at least one aperture in the upstream end wall being oval in cross-sectional shape, the at least one aperture in the upstream end wall having a major dimension in a radial direction and a minor dimension in a circumferential direction relative to the axis of the annular combustion chamber casing and the major dimension being greater than the minor dimension.

The centre line of the combustion chamber may be arranged at n angle to the axis of the annular combustion chamber casing.

The axis of the fuel injector head may be arranged at an angle to the axis of the annular combustion chamber casing and/or at an angle to the flange of the fuel injector and parallel to the centre line of the at least one combustion chamber.

The fuel injector head may have a part spherical surface and the part spherical surface of the fuel injector head abutting the at least one tubular seal.

The axis of the aperture through the at least one tubular seal may be arranged parallel to the axis of the fuel injector head.

The at least one aperture in the upstream end wall may have an oval race track cross-sectional shape.

The at least one aperture may have a corresponding locating ring and the locating ring having an oval aperture extending there-through. The oval aperture in the locating ring may be race track shaped. The locating ring may be aligned with the at least one aperture in the upstream end wall. The locating ring may be positioned axially between the flange of the tubular seal and an upstream surface of the upstream end wall. The locating ring may be positioned within the at least one aperture in the upstream end wall.

The at least one combustion chamber may have at least one heat shield, the at least one heat shield having an oval aperture extending there-through, the aperture in the at least one heat shield being aligned with the at least one aperture in the upstream end wall. The oval aperture in the at least one heat shield may be race track shaped.

A locating ring having may have an oval shaped aperture and an oval shaped outer surface, the locating ring aligning with the oval shaped aperture in the upstream end wall and a heat shield having an oval shaped aperture aligned with the aperture in the upstream end wall.

The at least one combustion chamber may be an annular combustion chamber, the upstream end wall having a plurality of circumferentially spaced apertures extending there-through, each aperture in the upstream end wall being oval in cross-sectional shape, each aperture in the upstream end wall having a major dimension in a radial direction and a minor dimension in a circumferential direction relative to the axis of the annular combustion chamber casing and the major dimension of each aperture being greater than the minor dimension of the respective aperture.

The at least one tubular seal having a guide feature and the combustion chamber assembly having a corresponding guide feature such that the at least one tubular seal is movable radially with respect to the axis of the annular combustion chamber casing. The corresponding guide feature may be provided on the locating ring, the heat shield or the upstream end wall.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
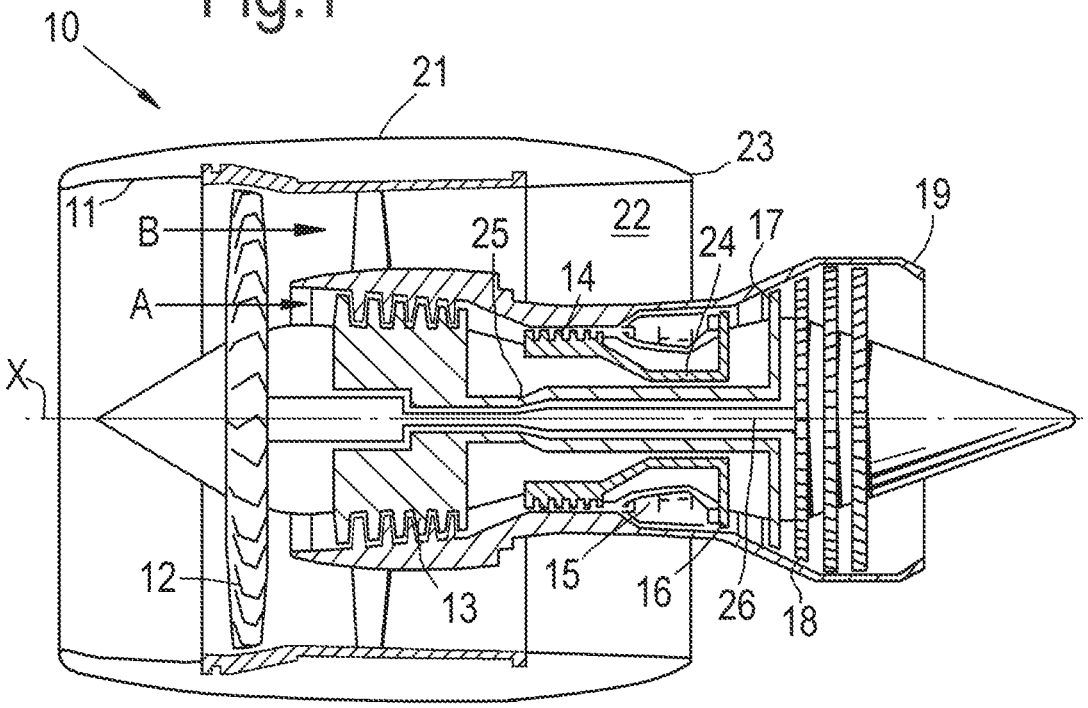
FIG. 1 is a sectional side view of a turbofan gas turbine engine.
Figure 2:
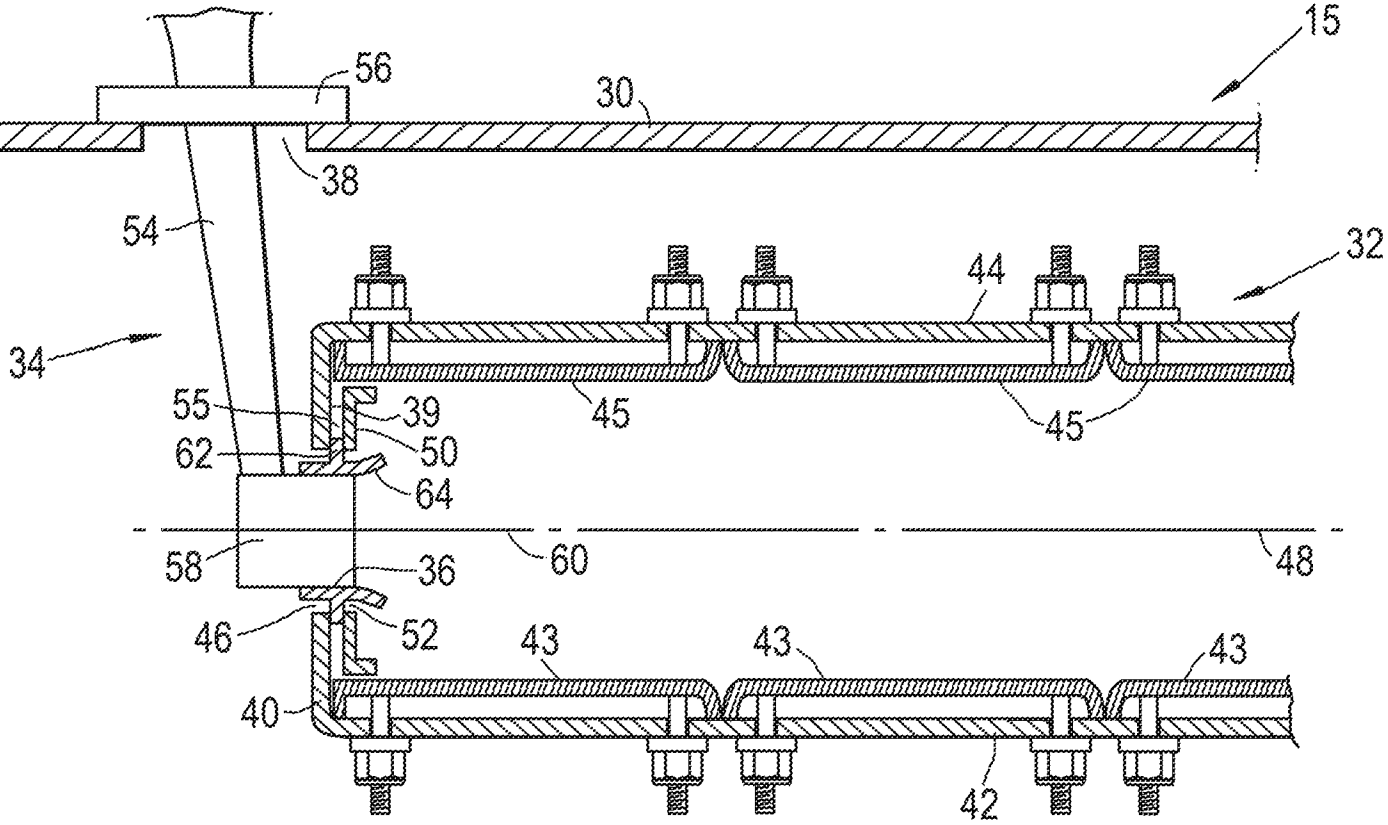
FIG. 2 is an enlarged schematic cross-sectional view of the combustion chamber assembly shown in FIG. 1.

With reference to FIG. 1, a turbofan gas turbine engine is generally indicated at 10, having a principal and rotational axis X. The engine 10 comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and an exhaust nozzle 19. A nacelle 21 generally surrounds the engine 10 and defines the intake 11, a bypass duct 22 and a bypass exhaust nozzle 23.

The gas turbine engine 10 works in the conventional manner so that air entering the intake 11 is compressed by the fan 12 to produce two air flows: a first air flow A into the intermediate pressure compressor 13 and a second air flow B which passes through the bypass duct 22 and the bypass exhaust nozzle 23 to provide propulsive thrust. The intermediate pressure compressor 13 compresses the air flow directed into it before delivering that air to the high pressure compressor 14 where further compression takes place. The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high 16, intermediate 17 and low 18 pressure turbines drive respectively the high pressure compressor 14, intermediate pressure compressor 13 and fan 12, each by suitable interconnecting shaft 24, 25 and 26 respectively.

The combustion chamber assembly 15 is shown more clearly in FIGS. 2 to 6 and the combustion chamber assembly 15 comprises an annular combustion chamber casing 30, an annular combustion chamber 32, a plurality of fuel injectors 34 and a plurality of tubular seals 36.

The annular combustion chamber casing 30 has an axis which is coaxial with the rotational axis X of the gas turbine engine 10 and the annular combustion chamber casing 30 has a plurality of apertures 38 extending there-through. The apertures 38 extend radially through the annular combustion chamber casing 30 and the apertures 38 are circumferentially spaced apart and are arranged in a common plane perpendicular to the axis of the annular combustion chamber casing 30. The apertures 38 are generally equally spaced circumferentially around the annular combustion chamber casing 30.

The annular combustion chamber 32 comprises an upstream end wall 40, a radially inner annular wall 42 and a radially outer annular wall 44. The upstream end of the radially inner annular wall 42 is secured to the upstream end wall 40 and the upstream end of the radially outer annular wall 44 is secured to the upstream end wall 40. The upstream end wall 40 is also known as a metering panel or metering wall. The upstream end wall 40 has a plurality of apertures 46 extending there-through. The apertures 46 extend perpendicularly through the upstream end wall 40 of the annular combustion chamber 32 and the apertures 46 are circumferentially spaced apart. The apertures 46 are generally equally spaced circumferentially around the upstream end wall 40 of the annular combustion chamber casing 32. The annular combustion chamber 32 and the centre line 48 of the combustion chamber 32 are arranged parallel to the axis of the annular combustion chamber casing 30 and the axis X of the turbofan gas turbine engine 10.

Figure 3:
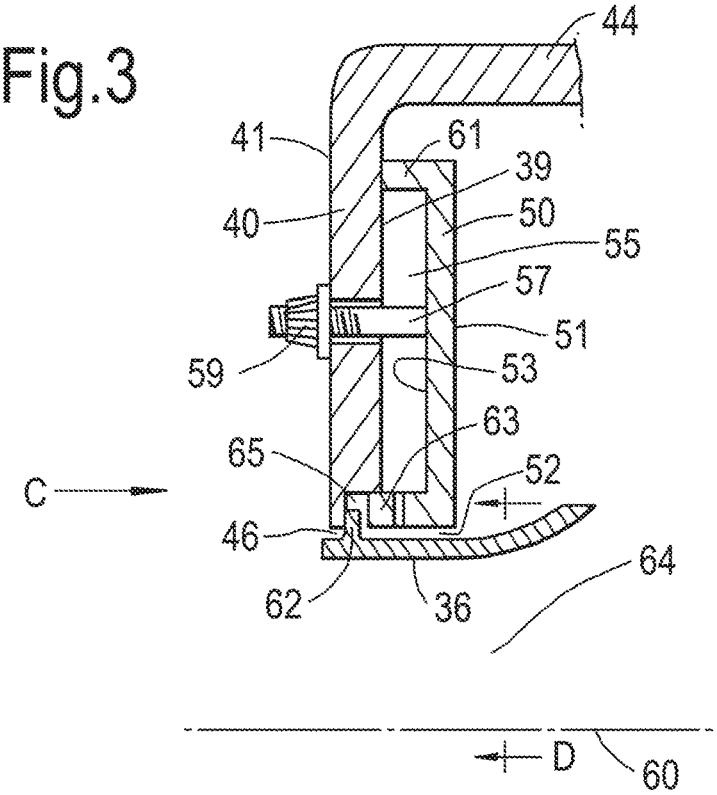
FIG. 3 is a further enlarged cross-sectional view of the upstream end of the combustion chamber assembly shown in FIG. 2.

The annular combustion chamber 32 also comprises a plurality of heat shields 50 on the upstream end wall 40 within the annular combustion chamber 32 to protect the upstream end wall 40 from the hot combustion gases, as seen more clearly in FIG. 3. The heat shields 50 are circumferentially arranged side by side on the upstream end wall 40 and each heat shield 50 has a central aperture 52 extending there-through which is aligned with, e.g. arranged generally coaxially with, a respective one of the apertures 46 in the upstream end wall 40. The heat shields 50 are adjacent to and spaced from the upstream end wall 40 of the annular combustion chamber 32. Each heat shield 50 is secured to the upstream end wall 40 by a plurality of threaded studs 57 which extend from the heat shield 50 through apertures in the upstream end wall 40 and which thread into corresponding nuts 59. However, the heat shields 50 may be secured to the upstream end wall 40 by other suitable arrangements. Each heat shield 50 has peripheral walls 61 extending from its radial and circumferentially extending edges to space the heat shield 50 from a first surface 39 of the upstream end wall 40 and to form a chamber 55 between the heat shield 50 and the upstream end wall 40. The peripheral walls 61 abut the first surface 39 of the upstream end wall 40. Each heat shield 50 also has a wall 63 extending from the perimeter of the central aperture 52 towards, but spaced from, the upstream end wall 40 to form a slot 65. The upstream end wall 40 has impingement cooling holes (not shown) extending there-through from a second surface 41 to the first surface 39 of the upstream end wall 40 to supply coolant, e.g. air, into the chambers 55 between the heat shields 50 and the upstream end wall 40 and each heat shield 50 has effusion cooling holes (not shown) extending there-through from a second surface 53 to a first surface 51 of the heat shield 50 to provide a film of coolant, e.g. air, over the first, hot, surface 51 of the heat shields 50.

The radially inner annular wall 42 may be provided with a plurality of tiles 43 spaced radially outwardly from the radially inner annular wall 42 at a greater radial distance to protect the radially inner annular wall 42 from the hot combustion gases. There may be one or more rows of circumferentially spaced tiles 43. Similarly, the radially outer annular wall 44 may be provided with a plurality of tiles 45 spaced radially inwardly from the radially outer annular wall 44 at a smaller radial distance to protect the radially outer annular wall 44 from the hot combustion gases. There may be one or more rows of circumferentially spaced tiles 45. Each tile 43, 45 is secured to the respective annular wall 42 or 44 by a plurality of threaded studs which extend from the tile 43, 45 through apertures in the respective annular wall 42 or 44 and which thread into corresponding nuts. However, the tiles 43, 45 may be secured to the annular walls 42 and 44 by other suitable arrangements.

Each fuel injector 34 comprises a fuel feed arm 54, a flange 56 and a fuel injector head 58. Each fuel injector 34 locates in a corresponding one of the apertures 38 in the annular combustion chamber casing 30 and the flange 56 of each fuel injector 34 is removably secured to the annular combustion chamber casing 30. The flange 56 of each fuel injector 34 is secured to a respective boss on the outside of the annular combustion chamber casing 30 by a plurality of bolts (not shown) which locate in threaded holes in the boss.

The fuel injector head 58 of each fuel injector 34 is located in a corresponding one of the apertures 46 in the upstream end wall 40. The fuel injector head 58 of each fuel injector 34 has an axis 60 and a plurality of coaxial passages, described below. The axis 60 of the fuel injector head 58 is arranged parallel to the axis of the annular combustion chamber casing 30, parallel to the flange 56 of the fuel injector 34 and the axis X of the turbofan gas turbine engine 10 and the axis 60 of the fuel injector head 58 is parallel to the centre line 48 of the annular combustion chamber 32. The centre line 48 of the annular combustion chamber 32 is arranged parallel to the axis of the annular combustion chamber casing 30.

Figure 6:
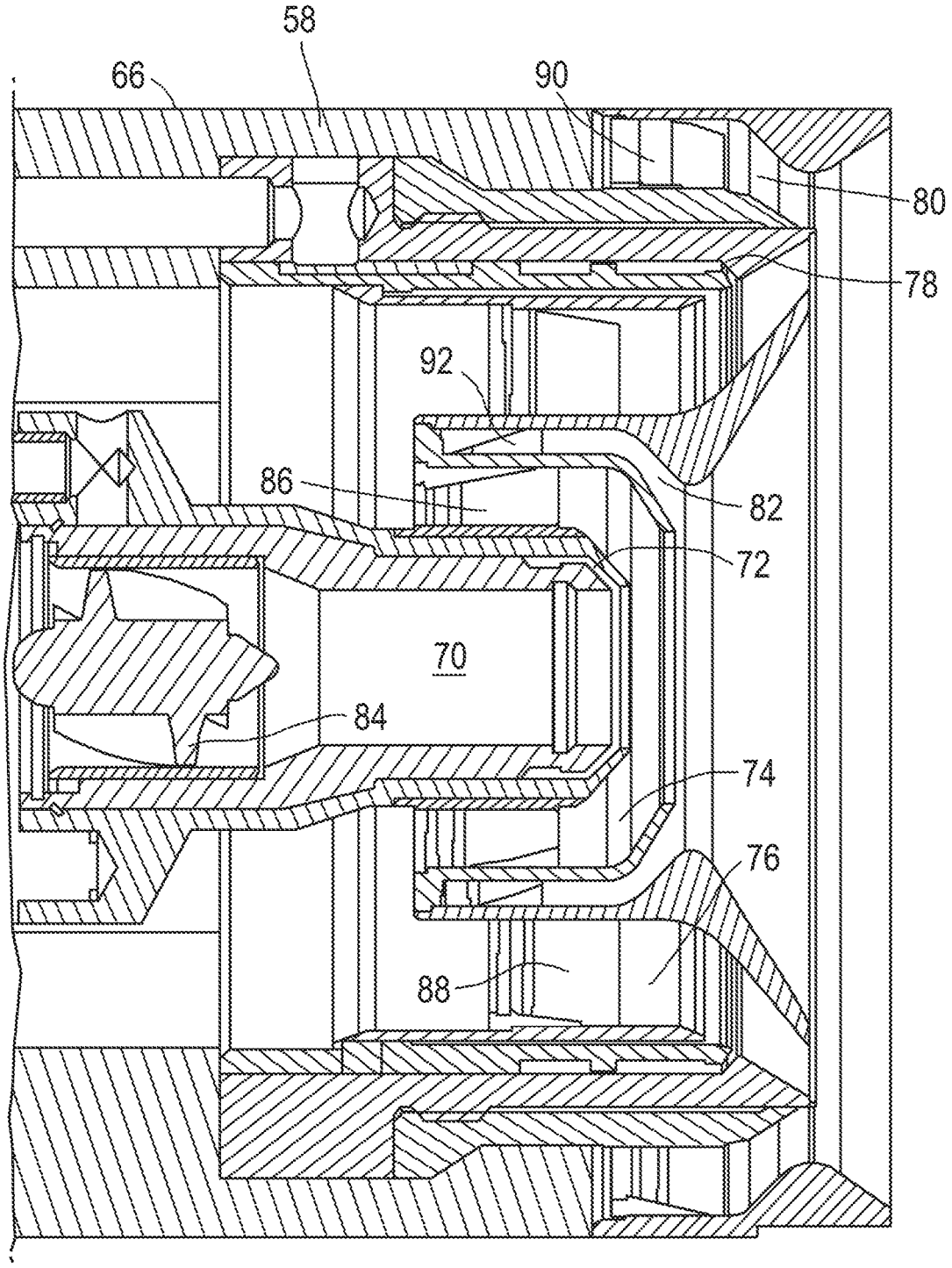
FIG. 6 is an enlarged cross-sectional view of a fuel injector head of a fuel injector shown in FIG. 2.

FIG. 6 shows a longitudinal cross-section through the fuel injector head 58 of one of the fuel injectors 34. The fuel injectors 34 are lean burn fuel injectors. The fuel injector head 58 has a coaxial arrangement of an inner pilot airblast fuel injector and an outer mains airblast fuel injector. The pilot airblast fuel injector has, in order from radially inner to outer, a coaxial arrangement of a pilot inner swirler air passage 70, a pilot fuel passage 72, and a pilot outer air swirler passage 74. The mains airblast fuel injector has, in order from radially inner to outer, a coaxial arrangement of a mains inner swirler air passage 76, a mains fuel passage 78, and a mains outer air swirler passage 80. An intermediate air swirler passage 82 is sandwiched between the outer air swirler passage 74 of the pilot airblast fuel injector and the inner swirler air passage 76 of the mains airblast fuel injector. The swirling air passing through the passages 70, 74, 76, 80, 82 of the fuel injector head 58 is high pressure and high velocity air derived from the high pressure compressor 14. Each swirler passage 70, 74, 76, 80, 82 has a respective swirler 84, 86, 88, 90, 92 which swirls the air flow through that passage.

Each tubular seal 36 is positioned between the associated fuel injector head 58 and the corresponding aperture 46 in the upstream end wall 40 of the annular combustion chamber 32. Each tubular seal 36 comprises a flange 62 and an aperture 64 extending through the tubular seal 36 and the axis of the aperture 64 is arranged parallel to the axis 60 of the fuel injector head 58. Each tubular seal 36 is movable radially and circumferentially with respect to the axis of the annular combustion chamber casing 30. Each tubular seal 36 is also movable radially with respect to the axis of the corresponding aperture 46 in the upstream end wall 40 of the annular combustion chamber 32. The flange 62 of each tubular seal 36 locates in a groove 65 defined by the upstream end wall 40 and a corresponding one of the heat shields 50.

Each fuel injector head 58 is located in the corresponding tubular seal 36 and each fuel injector head 58 has a cylindrical, or part spherical, surface 66 and the cylindrical, or part spherical, surface 66 of each fuel injector head 58 abuts the corresponding tubular seal 36. The contact between the cylindrical, or part spherical, surface 66 of each fuel injector head 58 and the corresponding tubular seal 36 forms an air seal. The axis of the fuel injector head 58 and the axis of the aperture 64 in the tubular seal 36 are coaxial.

Figure 4:
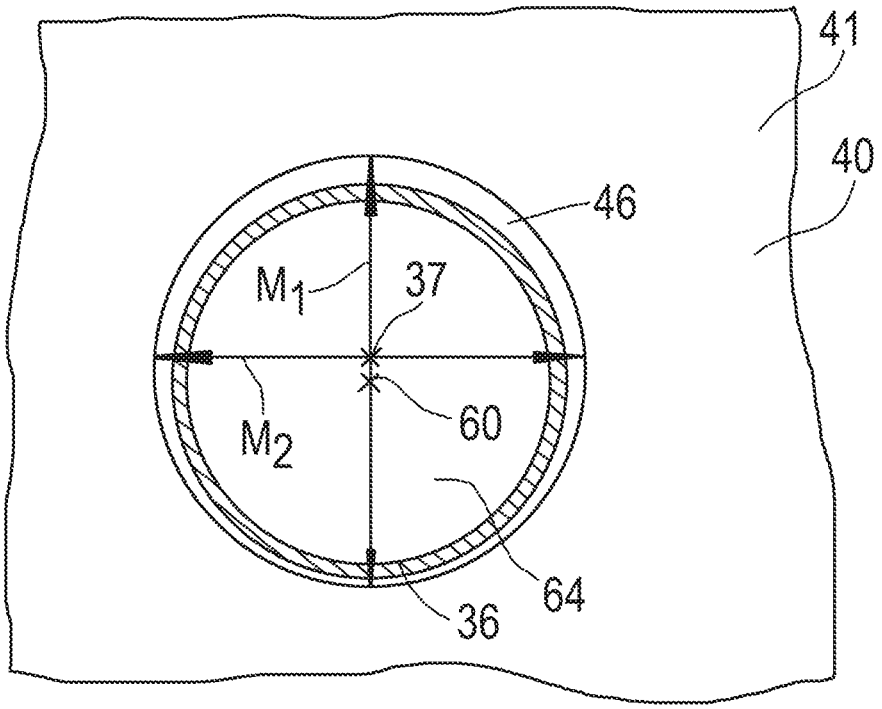
FIG. 4 is a view in the direction of arrow C in FIG. 3
Figure 5:
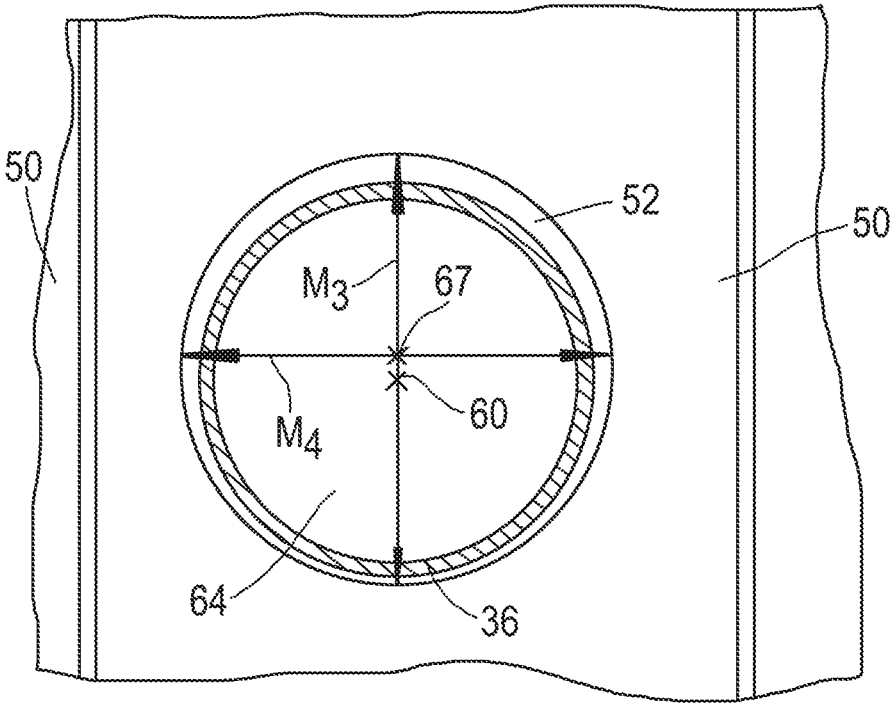
FIG. 5 is a cross-sectional view in the direction of arrow D in FIG. 3.

Each aperture 46 in the upstream end wall 40 is oval in cross-sectional shape, as seen more clearly in FIGS. 4 and 5, and each aperture 46 in the upstream end wall 40 has a major dimension M1 in a radial direction and a minor dimension M2 in a circumferential direction relative to the axis X of the annular combustion chamber casing 30 and the major dimension M1 is greater than the minor dimension M2. Each aperture 46 in the upstream end wall 40 in this example has an oval race track cross-sectional shape. Similarly, each heat shield 50 has an oval central aperture 52 which is aligned with the corresponding oval aperture 46 in the upstream end wall 40. The oval central aperture 52 in each heat shield 50 in this example has an oval race track cross-sectional shape. The central aperture 52 in each heat shield 50 has a major dimension M3 in a radial direction and a minor dimension M4 in a circumferential direction relative to the axis X of the annular combustion chamber casing 30 and the major dimension M3 is greater than the minor dimension M4. In this example the major dimensions M1 and M3 are the same and the minor dimension M2 and M4 are the same. The centre 67 of the oval aperture 52 in each heat shield 50 is aligned with the centre 37 of the corresponding oval aperture 46 in the upstream end wall 40.

It is to be noted that when the fuel injectors 34 are installed in the annular combustion chamber 32 that the axis 60 of each fuel injector head 58 and the axis of the corresponding tubular seal 36 may positioned radially inwardly of the positions of the corresponding centre 67 of the oval aperture 52 in the heat shield 50 and the corresponding centre 37 of the oval aperture 46 in the upstream end wall 40.

In order to remove a fuel injector 34, once the bolts have been removed from the flange 56 of the fuel injector 34, the fuel injector head 58 and the tubular seal are moved radially outwardly such that the axis 60 of the fuel injector head 58 and the axis of the corresponding tubular seal 36 are positioned radially outwardly of the corresponding centre 67 of the oval aperture 52 in the heat shield 50 and the corresponding centre 37 of the oval aperture 46 in the upstream end wall 40. The fuel injector 34 is then moved axially such that the fuel injector head 58 moves axially out of the corresponding tubular seal 36.

The advantage of the present disclosure is that the apertures in the upstream end wall of the annular combustion chamber are not circular but are oval with their major dimensions arranged radially such that it is not necessary to increase the diameter of the apertures in the upstream end wall and hence the distances and the amount of material between the aperture in the upstream end wall is not reduced and the strength of the upstream end wall is not reduced and the space available to provide impingement cooling holes in the upstream end wall is not reduced. Similarly, the central apertures in the heat shields of the annular combustion chamber are not circular but are oval with their major dimensions arranged radially such that it is not necessary to increase the diameter of the apertures in the heat shields and hence the distances and the amount of material between the aperture in the heat shields the peripheral walls is not reduced and the space available to provide effusion cooling holes in the heat shields is not reduced. Thus, the present disclosure increases the tubular seal clearance to enable lean burn fuel injectors to be installed and/or removed from the tubular seals located in the upstream end wall of the combustion chamber whilst minimising the amount of material, metal, removed from the upstream end wall and the heat shields. The working life of the heat shields used with lean burn fuel injectors is increased by maximising the cooling of the heat shields.

Figure 7:
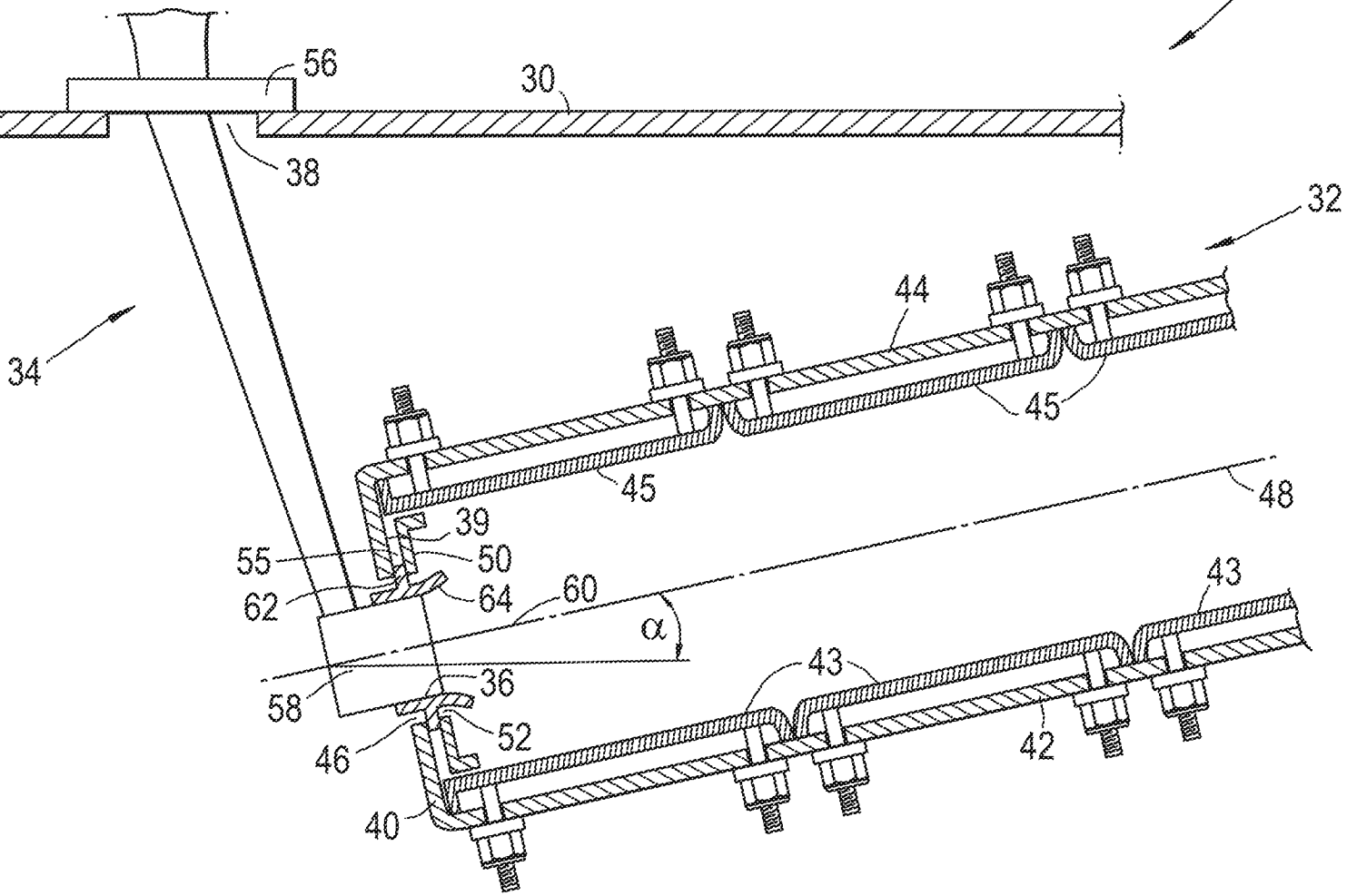
FIG. 7 is an alternative enlarged schematic cross-sectional view of the combustion chamber assembly shown in FIG. 1.

A further combustion chamber assembly 115 is shown more clearly in FIG. 7 and the combustion chamber assembly 115 is substantially the same as that shown in FIGS. 2 to 6 and comprises an annular combustion chamber casing 30, an annular combustion chamber 32, a plurality of fuel injectors 34 and a plurality of tubular seals 36. The combustion chamber assembly 115 differs in that the annular combustion chamber 32 and the centre line 48 of the combustion chamber 32 are arranged at an acute angle α to the axis of the annular combustion chamber casing 30 and the axis X of the turbofan gas turbine engine 10. Thus, it can be seen that in this arrangement the upstream end wall 40 is frusto-conical, e.g. the upstream end wall 40 is arranged on a part conical surface. In this arrangement, the axis 60 of each fuel injector head 58 is arranged at the acute angle α to the axis of the annular combustion chamber casing 30 and the axis X of the turbofan gas turbine engine 10 and the axis 60 of each fuel injector head 58 is parallel to the centre line 48 of the annular combustion chamber 32. The axis of each tubular seal 36 is arranged at the acute angle α to the axis of the annular combustion chamber casing 30 and the axis X of the turbofan gas turbine engine 10 and the axis of each tubular seal 36 is arranged parallel to the centre line 48 of the annular combustion chamber 32.

Again, in order to remove a fuel injector 34, once the bolts have been removed from the flange 56 of the fuel injector 34, the fuel injector head 58 and the tubular seal are moved radially outwardly such that the axis 60 of the fuel injector head 58 and the axis of the corresponding tubular seal 36 are positioned radially outwardly of the corresponding centre 67 of the oval aperture 52 in the heat shield 50 and the corresponding centre 37 of the oval aperture 46 in the upstream end wall 40. The fuel injector 34 is then moved axially such that the fuel injector head 58 moves axially out of the corresponding tubular seal 36.

The at least one aperture may have a corresponding locating ring and the locating ring having an oval aperture extending there-through. The oval aperture in the locating ring may be race track shaped. The locating ring may be aligned with the at least one aperture in the upstream end wall. The locating ring may be positioned axially between the flange of the tubular seal and an upstream surface of the upstream end wall. The locating ring may be positioned within the at least one aperture in the upstream end wall.

Figure 8:
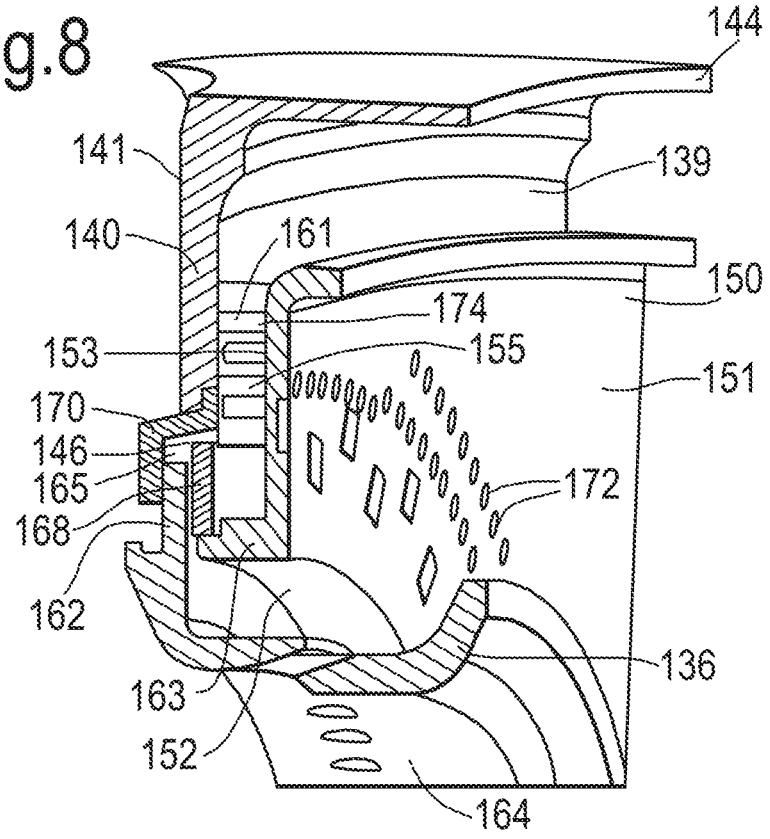
FIG. 8 is an enlarged alternative schematic cross-sectional view of an alternative upstream end wall of the combustion chamber assembly shown in FIG. 2 or FIG. 7.

A combustion chamber assembly with an alternative upstream end wall 140 arrangement is shown in FIG. 8. The upstream end wall 140 has first and second surfaces 139 and 141 and an oval aperture 146. Each heat shield 150 has first and second surface 151 and 153 and an oval aperture 152. A chamber 155 is formed between each heat shield 150 and the upstream end wall 140. Each tubular seal 136 is positioned in a corresponding one of the oval apertures 146 in the upstream end wall 140 and in an oval central aperture 152 in the corresponding heat shield 150. The flange 162 of each tubular seal 136 is located axially in a groove 165 defined between a first oval locating ring 168 and a second oval locating ring 170. The first oval locating ring 168 is located radially between the peripheral wall 163 around the oval central aperture 152 of the heat shield 150 and the upstream end wall 140. The second oval locating ring 170 is Z-shaped in cross-section and comprises a first portion, an axially central portion and a third portion. The first portion extends radially outwardly from the downstream end of the axially central portion and hooks onto the upstream end wall 140 and the third portion extends radially inwardly from the upstream end of the axially central portion to hook over the flange 162 of the tubular seal 136. The heat shields 150 have effusion cooling apertures 172 extending there-through from their first surfaces 151 to their second surfaces 153 and pedestals 174 extending from their second surfaces 153.

Figure 9:
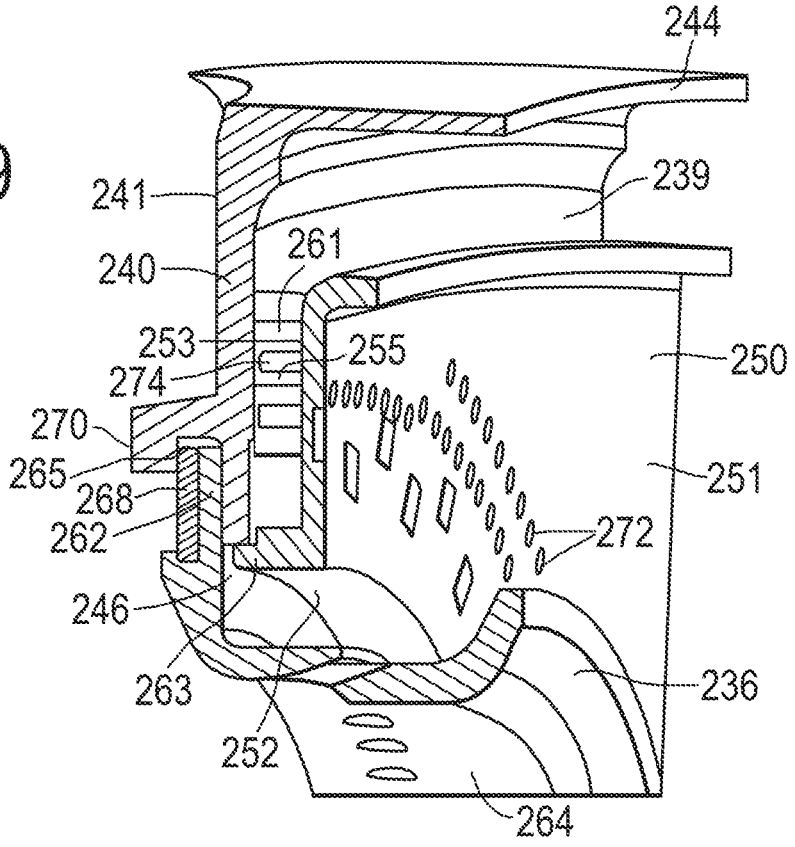
FIG. 9 is an enlarged alternative schematic cross-sectional view of another alternative upstream end wall the combustion chamber assembly shown in FIG. 2 or FIG. 7.

A further combustion chamber assembly with an alternative upstream end wall 240 arrangement is shown in FIG. 9. The upstream end wall 240 has first and second surfaces 239 and 241 and an oval aperture 246. Each heat shield 250 has first and second surface 251 and 253 and an oval aperture 252. A chamber 255 is formed between each heat shield 250 and the upstream end wall 240. Each tubular seal 236 is positioned in a corresponding one of the oval apertures 246 in the upstream end wall 240 and in an oval central aperture 252 in the corresponding heat shield 250. The flange 262 of each tubular seal 236 is located axially in a groove 265 defined between a first oval locating ring 268 and the upstream end wall 240. The upstream end wall 240 has an oval locating hook 270 which comprises a first portion which extends axially from the second surface 141 and a second portion which extends radially inwards from the upstream end of the first portion to hook over the first oval locating ring 270. The peripheral wall 263 around the oval central aperture 252 of the heat shield 250 abuts the upstream end wall 240. The heat shields 250 have effusion cooling apertures 272 extending there-through from their first surfaces 251 to their second surfaces 253 and pedestals 274 extending from their second surfaces 253.

Figure 10:
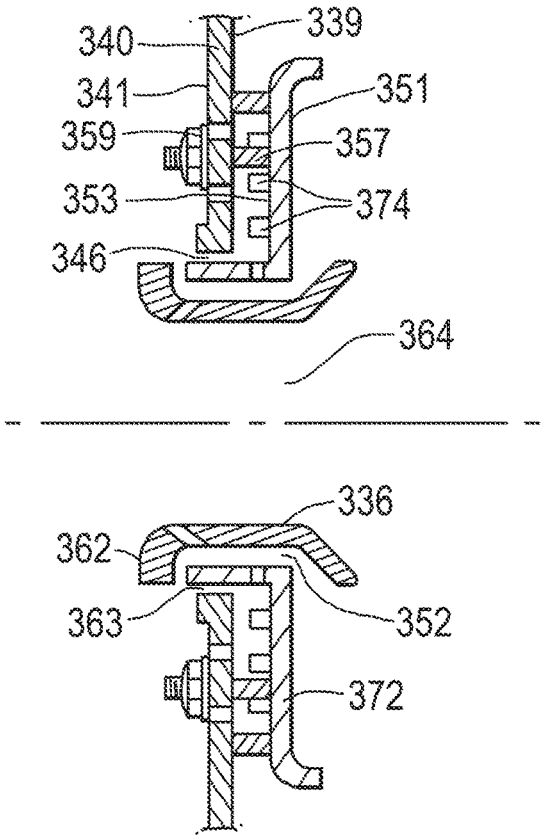
FIG. 10 is an enlarged alternative schematic cross-sectional view of a further alternative upstream end wall the combustion chamber assembly shown in FIG. 2 or FIG. 7.

Another combustion chamber assembly with an alternative upstream end wall 340 arrangement is shown in FIG. 10. The upstream end wall 340 has first and second surfaces 339 and 341 and an oval aperture 346. Each heat shield 350 has first and second surface 351 and 353 and an oval aperture 352. A chamber 355 is formed between each heat shield 350 and the upstream end wall 340. Each tubular seal 336 is positioned in a corresponding one of the oval apertures 346 in the upstream end wall 340 and in an oval central aperture 352 in the corresponding heat shield 350. Each tubular seal 336 extends axially through the oval aperture 246 in the upstream end wall 340 and through the oval aperture 352 in a corresponding one of the heat shields 350. Each tubular seal 336 is trapped in the corresponding heat shield 350 due to the upstream and downstream ends of the tubular seal 336 extending radially outwards and the heat shield 350 and tubular seal 336 are manufactured together by additive layer manufacturing. The peripheral wall 363 around the oval central aperture 352 of the heat shield 350 extends upstream and into the oval aperture 346 of the upstream end wall 340. The heat shields 350 have effusion cooling apertures 372 extending there-through from their first surfaces 351 to their second surfaces 353 and pedestals 374 extending from their second surfaces 353.

A locating ring may have an oval shaped aperture and an oval shaped outer surface, the locating ring aligning with the oval shaped aperture in the upstream end wall and a heat shield having an oval shaped aperture aligning with the aperture in the upstream end wall. The locating ring may locate in the oval shaped aperture in the upstream end wall.

The combustion chamber assembly may have guide features provided on the tubular seal and corresponding guide features provided on adjacent structure such that the tubular seal moves radially with respect to the combustion chamber. The tubular seal may be movable radially with respect to the axis of the annular combustion chamber casing. The corresponding guide features may be provided on the locating ring, the heat shield or the upstream end wall.

The at least one combustion chamber may be an annular combustion chamber, the upstream end wall having a plurality of circumferentially spaced apertures extending there-through, each aperture in the upstream end wall being oval in cross-sectional shape, each aperture in the upstream end wall having a major dimension in a radial direction and a minor dimension in a circumferential direction relative to the axis of the annular combustion chamber casing and the major dimension of each aperture being greater than the minor dimension of the respective aperture.

The axis of the fuel injector head may be arranged at an angle to the axis of the annular combustion chamber casing and/or at an angle to the flange of the fuel injector and parallel to the centre line of the at least one combustion chamber.

The at least one combustion chamber may be a tubular combustion chamber.

Although the present disclosure has been described with reference to lean burn fuel injectors it is equally applicable to rich burn fuel injectors, especially if they have relatively large outside diameter and a relatively large axial length.

Although the present disclosure has been described with reference to a turbofan gas turbine engine it is equally applicable to a turbojet gas turbine engine, a turbo-propeller gas turbine engine or a turbo-shaft gas turbine engine.

Although the present disclosure has been described with reference to an aero gas turbine engine it is equally applicable to a marine gas turbine engine, an automotive gas turbine engine or an industrial gas turbine engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber assembly comprising
an annular combustion chamber casing,
at least one combustion chamber,
at least one fuel injector, and at least one tubular seal,
the combustion chamber casing having an axis and at least one aperture extending there-through,
the combustion chamber having a centre line,
the combustion chamber comprising an upstream end wall having at least one aperture extending there-through,
the at least one fuel injector comprising a fuel feed arm, a flange and a fuel injector head,
the at least one fuel injector being locatable in the at least one aperture in the annular combustion chamber casing,
the flange of the at least one fuel injector being securable to the annular combustion chamber casing,
the fuel injector head of the at least one fuel injector being locatable in the at least one aperture in the upstream end wall,
the fuel injector head having an axis and a plurality of annular passages,
the at least one tubular seal being positionable between the fuel injector head and the at least one aperture in the upstream end wall,
the at least one tubular seal having a flange, an aperture extending through the at least one tubular seal,
the at least one tubular seal being movable radially and circumferentially with respect to the axis of the annular combustion chamber casing,
the fuel injector head being locatable in the at least one tubular seal,
the at least one aperture in the upstream end wall being oval in cross-sectional shape,
the at least one aperture in the upstream end wall having a major dimension in a radial direction and a minor dimension in a circumferential direction relative to the axis of the annular combustion chamber casing and the major dimension being greater than the minor dimension, and further comprising a locating ring having an oval shaped aperture and an oval shaped outer surface, the locating ring aligning with the oval shaped aperture in the upstream end wall and a heat shield having an oval shaped aperture aligned with the aperture in the upstream end wall.

2. A combustion chamber assembly as claimed in claim 1 wherein the centre line of the combustion chamber is arranged at an angle to the axis of the annular combustion chamber casing.

3. A combustion chamber assembly as claimed in claim 1 wherein the axis of the fuel injector head is arranged at an angle to the axis of the annular combustion chamber casing and/or at an angle to the flange of the fuel injector and parallel to the centre line of the at least one combustion chamber.

4. A combustion chamber assembly as claimed in claim 1 wherein the fuel injector head has a part spherical surface and the part spherical surface of the fuel injector head abuts the at least one tubular seal.

5. A combustion chamber assembly as claimed in claim 1 wherein the axis of the aperture through the at least one tubular seal is arranged parallel to the axis of the fuel injector head.

6. A combustion chamber assembly as claimed in claim 1 wherein the at least one aperture in the upstream end wall has an oval race track cross-sectional shape.

7. A combustion chamber assembly as claimed in claim 1 wherein the oval shaped aperture in the locating ring is race track shaped.

8. A combustion chamber assembly as claimed in claim 1 wherein the locating ring is positioned axially between the flange of the tubular seal and an upstream surface of the upstream end wall.

9. A combustion chamber assembly as claimed in claim 1 wherein the locating ring is positioned within the at least one aperture in the upstream end wall.

10. A combustion chamber assembly as claimed in claim 1 wherein the at least one combustion chamber has at least one heat shield, the at least one heat shield has an oval aperture extending there-through, and the aperture in the at least one heat shield is aligned with the at least one aperture in the upstream end wall.

11. A combustion chamber assembly as claimed in claim 10 wherein the oval aperture in the at least one heat shield is race track shaped.

12. A combustion chamber assembly as claimed in claim 1 wherein the at least one combustion chamber is an annular combustion chamber, the upstream end wall has a plurality of circumferentially spaced apertures extending there-through, each aperture in the upstream end wall is oval in cross-sectional shape, each aperture in the upstream end wall has a major dimension in a radial direction and a minor dimension in a circumferential direction relative to the axis of the annular combustion chamber casing and the major dimension of each aperture is greater than the minor dimension of the respective aperture.

13. A combustion chamber assembly as claimed in claim 1 wherein the at least one tubular seal has a guide feature and the combustion chamber assembly has a corresponding guide feature such that the at least one tubular seal is movable radially with respect to the axis of the annular combustion chamber casing.

14. A combustion chamber assembly as claimed in claim 1 wherein the fuel injector head has a cylindrical surface and the cylindrical surface of the fuel injector head abuts the at least one tubular seal.

15. A combustion chamber assembly comprising an annular combustion chamber casing, an annular combustion chamber, at least one fuel injector, and at least one tubular seal, the combustion chamber casing having an axis and at least one aperture extending there-through, the combustion chamber having a centre line, the combustion chamber comprising a radially inner annular wall, a radially outer annular wall and an upstream end wall, the upstream end wall having at least one aperture extending there-through, the at least one fuel injector comprising a fuel feed arm, a flange and a fuel injector head, the at least one fuel injector being locatable in the at least one aperture in the annular combustion chamber casing, the flange of the at least one fuel injector being securable to the annular combustion chamber casing, the fuel injector head of the at least one fuel injector being locatable in the at least one aperture in the upstream end wall, the fuel injector head having an axis and a plurality of annular passages, the at least one tubular seal being positionable between the fuel injector head and the at least one aperture in the upstream end wall, the at least one tubular seal having a flange, an aperture extending through the at least one tubular seal, the at least one tubular seal being movable radially and circumferentially with respect to the axis of the annular combustion chamber casing, the fuel injector head being locatable in the at least one tubular seal, the fuel injector head having a part spherical surface, the part spherical surface of the fuel injector head abutting the at least one tubular seal, the at least one aperture in the upstream end wall being oval in cross-sectional shape, the at least one aperture in the upstream end wall having a major dimension in a radial direction and a minor dimension in a circumferential direction relative to the axis of the annular combustion chamber casing and the major dimension being greater than the minor dimension, and further comprising a locating ring having an oval shaped aperture and an oval shaped outer surface, the locating ring aligning with the oval shaped aperture in the upstream end wall and a heat shield having an oval shaped aperture aligned with the aperture in the upstream end wall.

* * * * *